United States Patent [19]

Beaulieu et al.

[11] 3,990,077

[45] Nov. 2, 1976

[54] ELECTRICALLY SCANNED ANTENNA FOR DIRECTION ERROR MEASUREMENT

[75] Inventors: Louis Jean Beaulieu, L'Hay-les-Roses; Daniel Edmond Beguin, Saint-Prix, both of France

[73] Assignee: International Standard Electric Corporation, New York, N.Y.

[22] Filed: June 23, 1975

[21] Appl. No.: 589,162

[30] Foreign Application Priority Data

June 28, 1974 France ..... 74.22636

[52] U.S. Cl. ..... 343/854; 343/768

[51] Int. Cl.[2] ..... H01Q 3/26

[58] Field of Search ..... 343/771, 778, 854

[56] References Cited

UNITED STATES PATENTS 3,906,502 9/1975 Connolly ..... 343/854

*Primary Examiner*—Eli Lieberman

*Attorney, Agent, or Firm*—John T. O'Halloran

[57] ABSTRACT

This invention relates to an electronically scanned array antenna with independent sum and difference excitations. The coupling coefficients of the feeding directional couplers are defined from a predetermined relation between the sum and difference excitations of each radiating source so that the maximum of the sum pattern and the nil of the difference pattern coincide whatever the scanning angle.

1 Claim, 4 Drawing Figures

ELECTRICALLY SCANNED ANTENNA FOR DIRECTION ERROR MEASUREMENT

This invention refers to an electronically scanned monopulse antenna.

An antenna for monopulse radar is an antenna capable of radiating in two patterns which overlap, for example by means of two primary sources simultaneously illuminating the same aerial. The amplitudes of the signals received on the two primary sources are added and subtracted so as to obtain sum Σ and difference Δ signals. The difference Δ signal is cancelled for an objective whose direction is identical with the axis of the antenna, while the Σ signal is maximum.

The use of sources such as a multimode horn is also familiar which permits patterns identical to the preceeding Σ and Δ patterns to be obtained. In such horns, several modes can be propagated simultaneously. By combining several modes of propagation, for example the first three transverse electrical modes, the desired laws of illumination for the sum Σ and difference Δ signals can be created in the horn beamwidth. We can thus combine the two even symmetry modes H10 and H30 to obtain the Σ signal, with the odd symmetry mode H20 supplying the Δ signal. The advantage of this method is to permit obtaining Σ and Δ patterns whose laws of illumination are independent of one another due to the possibilities of adjusting the relative amplitudes of the different modes of like parity. So this solution offers greater flexibility for optimum adjustment of both radiation patterns (reduction of side lobes, linearity of the Δ/Σ ratio, gain of the Σ channel, etc. . . . ).

Another solution for the design of a monopulse antenna is the use of an array antenna series-fed by a single line and directional couplers connected to the different elementary sources, the line being center-fed through a hybrid junction supplying the sum and difference signals. The level of excitation of the different sources is determined by the couplers, and it is clear that the sum and difference patterns are not independent. If the different excitation amplitudes are adjusted for a good sum pattern, the difference pattern will be mediocre and vice versa. A solution to this problem giving complete independence of excitation for the sum and difference patterns has been described in an article by Alfred R. Lopez, entitled "Monopulse networks for series feeding an array antenna", and published in I.E.E.E. Transactions on Antennas and Propagation, Volume AP-16 no. 4, July 1968, pages 436 to 440. This solution, for a series-fed array antenna, consists of using at least a second feeder line with a central hybrid junction, one of whose inputs is not used while the other is coupled to the corresponding input of the hybrid junction of the main feeder line. This results in complete independence of the sum and difference patterns. However, when it is desired to use such an antenna for direction error measurement with electronic scanning, with quantized phase shifters, it is observed that when the direction of the antenna axis is changed, the directions of the maximum of the sum pattern and of the minimum of the difference pattern do not change by the same amount and no longer coincide. The result of this, in particular, is a distortion of the Δ/Σ ratio during scanning, which makes such an antenna unsuitable for use in direction error measurements.

One object of this invention is an electronically scanned antenna which does not present this problem.

According to the invention there is provided an electronically scanned monopulse antenna used for direction error measurements and including an array of radiating sources, a first series network for feeding said sources through transmission lines and first couplers coupling these lines to the radiating sources by means of variable quantized phase shifters, a second series network for feeding said sources through transmission lines and second couplers coupling these lines to the radiating sources by means of the corresponding first couplers, a first and a second hybrid junction to center-feed the first and second network respectively, one of the sum or difference channels of the first junction providing the corresponding sum Σ or difference Δ excitation of the antenna and the other channel being coupled through a coupler to the similar channel of the second junction, this coupler distributing the other Δ or Σ excitation of the antenna, the said antenna being characterized in that the coupling coefficients of the various couplers used are chosen in such a way that, for each radiating source, the relation:

$$An\Delta = B(2n-1)An\Sigma$$

is confirmed, $n$ being the row of the source counting from the center of the array, $An\Delta$ and $An\Sigma$ the excitation amplitudes of the row $n$ radiating source corresponding respectively to the difference Δ and sum Σ excitations of the antenna, and B a constant.

The invention will be better understood and other characteristics will be brought out in the following description and attached drawings in which.

Figure 1A:
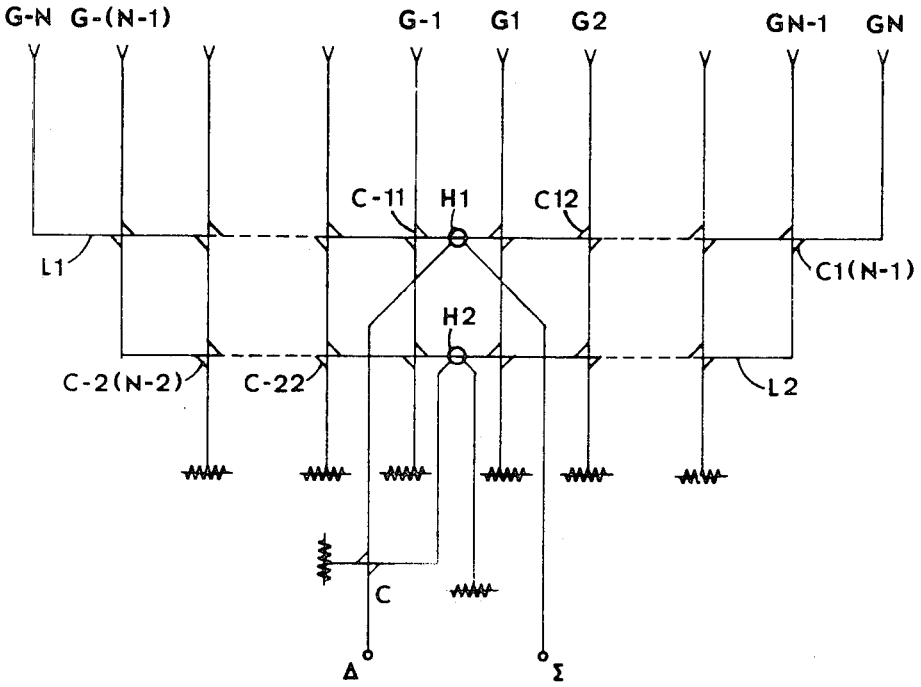
FIG. 1a PRIOR ART
FIG. 1 shows a known type of monopulse array antenna and the amplitude distribution diagrams for the Σ and Δ excitations.
Figure 1B:
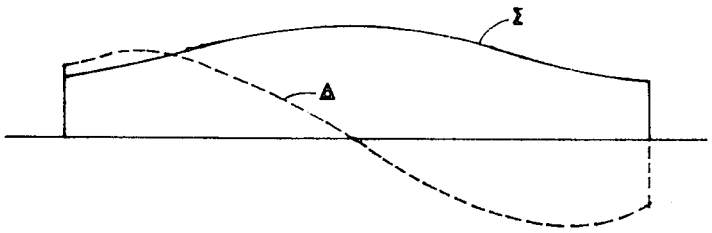

In FIG. 1, we have shown in (a) the diagram of a known monopulse array antenna which allows obtaining independent excitations through the sum Σ and difference Δ channels. In the description which follows, only the feeding of a linear array is considered since the extension of the indicated principles to plane array antennas can be seen clearly.

The antenna shown includes 2N in-line radiators G-N to GN spaced uniformly. In addition, these sources could each consist of a slotted waveguide, these guides being laid out in parallel to form a plane array of radiating slots. A first feeder line L1 supplies the sources through 2N−2 coupler C−1(N−1) to C1(N−1). Line L1 itself is center-fed by a hybrid junction H1 whose sum output serves as Σ excitation of the antenna. A second feeder line L2 is used to superpose an auxiliary amplitude distribution on the sources G-N to GN through a second series of couplers C−2(N−2) to C2(N−2) and couplers of line L1. This second line L2 itself is center-fed by a hybrid junction H2 whose sum arm is closed with a matched load and whose difference arm receives a part of the Δ excitation supplied by a coupler C.

It is clear that if we had only the line L1, in choosing the couplers of this line to have the proper Σ excitation, we would have an identical Δ excitation with an abrupt change of phase of $\pi$ at the center of the array. This would then lead, because of the dependence between the Δ and Σ excitations, to an improper Δ excitation. By means of line L2, we add to the improper Δ1 excitation a Δ2 excitation which is adjusted so as to obtain a resulting Δ excitation having the desired characteristics, while the coupler C is used to adjust the proper ratio between Δ1 and Δ2. FIG. 1 (b) shows the independent Δ and Σ excitations obtained. Such a solution is described more fully in the above-mentioned article by Alfred R. Lopez.

Such an antenna gives very good results when used as a monopulse antenna because it allows completely independent control of both excitations, has no losses and has a symmetrical design.

Figure 2:
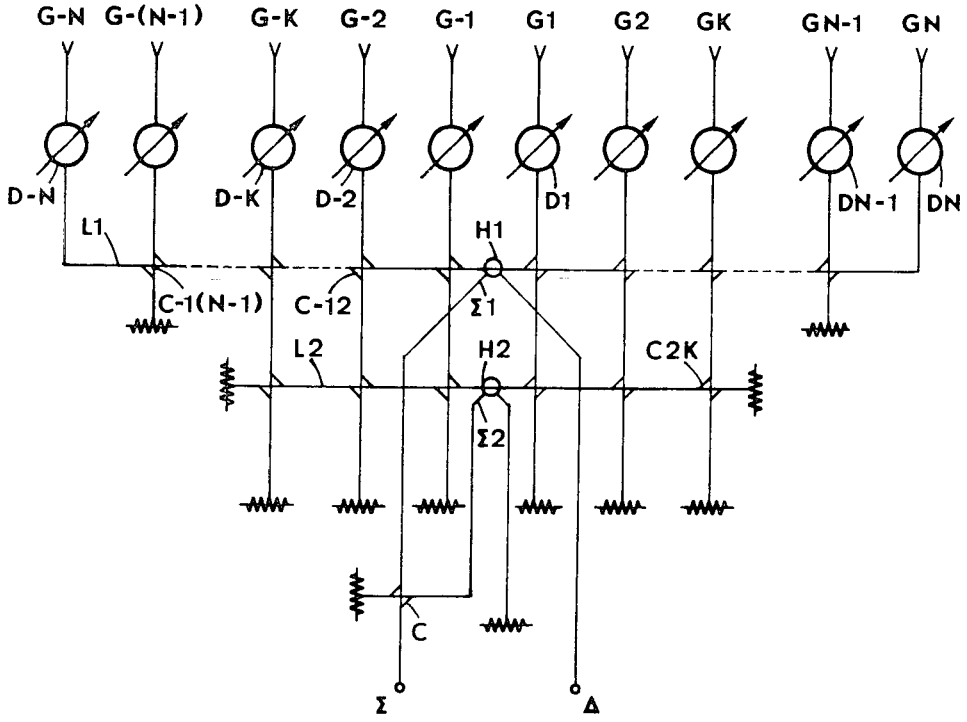
FIG. 2 represents an embodiment of the electronically scanned antenna according to the invention.

FIG. 2 shows an antenna with electronic scanning using the principle described above. Like elements are designated by the same reference numbers as in FIG. 1.

Figure 3:
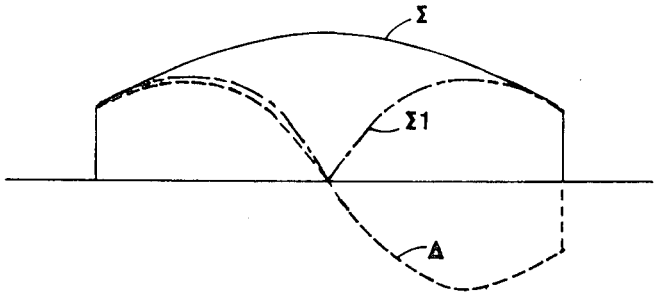
FIG. 3 is an amplitude distribution diagram for the various excitations.

Among other things, this antenna includes a series of 2N controlled variable digital phase shifters D-N to DN laid out respectively between the sources and couplers of line L1, these phase shifters being used in transmission and reception. With respect to the antenna in FIG. 1, there are some other differences. First of all, line L2 participates in the excitation of the 2K center sources only. Actually, it appears that for the outer sources the Δ and Σ excitation diagrams are very similar (FIG. 1 (b)) and that it is therefore possible to excite these sources in a non-independent way without noticeable degradation of the antenna characteristics. In addition, line L1 excites the difference Δ mode instead of the sum mode. The purpose of this is simply to give preference to the difference pattern, whose characteristics are more important when it is desired to use such a monopulse antenna for direction error measurement. Therefore, the Δ excitation is adjusted as well as possible and then a good Σ pattern is obtained by adding to the Σ1 excitation, which is poor due to the amplitude minimum at the center of the array (FIG. 3), a Σ2 excitation obtained by means of line L2, junction H2 and coupler C.

However, if we design an electronic scanning antenna according to this principle without other precautions, we observe that such an antenna is not satisfactory for making direction error measurements. Actually, for such an application, regardless of the scanning angle, we need a ratio of received signals Δ/Σ as linear as possible in the area located on both sides of the maximum of the Σ pattern, this ratio having a substantially constant slope, and it is especially necessary that the maximum of the sum pattern always coincide with the zero of the difference pattern. Now, it will be noted that these conditions are not generally attained when the phase shifters used are digital control phase shifters, as it is usually the case.

According to the invention, advantage is taken of the fact that the Σ and Δ excitations are independent to adjust these so that, for each source:

$$An\Delta = B(2n-1)An\Sigma \qquad (1)$$

where AnΔ and AnΣ are the Δ and Σ excitation amplitudes for the sources Gn or g—*n* respectively, *n* varies from 1 to N, and where B is a standard constant. It can be shown that when the equation (1) is respected, the maximum of the sum pattern and the zero of the difference pattern coincide, regardless of the scanning angle, i.e. the angle between the direction of the sum pattern maximum and the perpendicular to the array, since this relation is independent of the phase of each source. We can thus adopt for example a suitable Σ amplitude distribution in order to reduce the level of the side lobes (distribution according to a cosine squared law or a Taylor's law for example), the Δ distribution being given by equation (1). From the desired law and the equation (1), we can therefore determine the coupling coefficients to be used for each of the couplers of line L1 and L2. Due to this special determination according to the invention, an antenna is obtained for which the maximum of the sum pattern and the zero of the difference pattern always coincide, presenting low level side lobes, whose linearity and symmetry of the Δ/Σ ratio are always good, and for which certain characteristics can be optimized by first deciding the amplitude distributions, either Σ or Δ, provided that equation (1) is respected.

Other problems are posed with an electronic scanning antenna due to quantization of the phase when digital phase shifters are used. It is known, in this case, that high level side lobes may appear due to the periodicity of the phase error introduced with respect to the ideal linear phase law. However, known methods for getting around this problem are applicable to the antenna according to the invention which do not noticeably affect its features. Such methods consist for example in introducing an additional quadratic phase error into the system, or in modifying the phase condition of certain phase shifters with respect to the condition indicated by the most linear law possible, or then again in modifying the phase law between transmission and reception. Since this does not affect the amplitude distributions, so long as equation (1) is respected, the linearity and symmetry of the ratio ΔΣ remain good regardless of the scanning angle. The only noticeable change is a shift in the actual scanning direction with respect to the theoretical direction for the controlled phase distribution. This shift is easily calculated or measured and can therefore be taken into account in the operation of the antenna.

Of course, the embodiment described in no way limits the invention.

We claim:

1. An electronically scanned monopulse antenna used for direction error measurements and including an array of radiating sources, a first series network for feeding said sources through transmission lines and first couplers coupling these lines to the radiating sources by means of variable phase shifters, a second series network for feeding said sources through transmission lines and second couplers coupling these lines to the radiating sources by means of the corresponding first couplers, a first and a second hybrid junction to center-feed the first and second network respectively, one of the sum or difference channels of the first junction providing the corresponding sum Σ or difference Δ excitation of the antenna and the other channel being coupled through a coupler to the similar channel of the second junction, this coupler distributing the other Δ or Σ excitation of the antenna, the said antenna being characterized in that the coupling coefficients of the various couplers used are chosen in such a way that, for each radiating source, the relation:

$$An\Delta = B(2n-1)An\Sigma$$

is confirmed, *n* being the row of the source counting from the center of the array, *An*Δ and *An*Σ the excitation amplitudes of the row *n* radiating source corresponding respectively to the difference Δ and sum Σ excitations of the antenna, and *B* a constant.

* * * * *